US008302846B2

(12) United States Patent
Koeda et al.

(10) Patent No.: US 8,302,846 B2
(45) Date of Patent: Nov. 6, 2012

(54) PAPER CONTAINER

(75) Inventors: Fujio Koeda, Tokyo (JP); Toshinari Shimizu, Tokyo (JP); Osamu Tuchida, Tokyo (JP); Youhei Tominaga, Tokyo (JP); Atsushi Tanaka, Tokyo (JP); Yoshihiro Urano, Tokyo (JP)

(73) Assignee: Nippon Paper-Pak Co., Ltd., Tokyo (JP)

( * ) Notice: Subject to any disclaimer, the term of this patent is extended or adjusted under 35 U.S.C. 154(b) by 254 days.

(21) Appl. No.: 12/733,856

(22) PCT Filed: Jun. 29, 2009

(86) PCT No.: PCT/JP2009/002977

§ 371 (c)(1),
(2), (4) Date: May 19, 2010

(87) PCT Pub. No.: WO2010/001573

PCT Pub. Date: Jan. 7, 2010

(65) Prior Publication Data

US 2010/0237142 A1 Sep. 23, 2010

(30) Foreign Application Priority Data

Jun. 30, 2008 (JP) ..... 2008-171381
Jun. 30, 2008 (JP) ..... 2008-171382

(51) Int. Cl.
*B65D 5/74* (2006.01)

(52) U.S. Cl. ..... 229/125.42; 229/137; 229/249

(58) Field of Classification Search ..... 229/125.42, 229/137, 213, 214, 249
See application file for complete search history.

(56) References Cited

U.S. PATENT DOCUMENTS 3,094,432 A * 6/1963 Meyer-Jagenberg ..... 229/214
(Continued)

FOREIGN PATENT DOCUMENTS

JP 50-88339 7/1975
(Continued)

OTHER PUBLICATIONS

International Search Report issued Sep. 1, 2009 in International (PCT) Application No. PCT/JP2009/002977.

*Primary Examiner* — Gary Elkins
(74) *Attorney, Agent, or Firm* — Wenderoth, Lind & Ponack, L.L.P.

(57) ABSTRACT

A paper container includes four body portion panels forming a cylindrical body portion having a square section. The paper container is configured so that upper ends of the body portion panels are continuously provided with a pair of gable roof-forming panels which include exterior top seal panels opposed to each other, and provided with a pair of gable wall-forming panels which include interior top seal panels opposed to each other. Any one of the panels serves as a spout and is to be opened. The gable wall-forming panels are folded out between the gable roof-forming panels, and the exterior top seal panels and the interior top seal panels are heated and sealed with each other at a predetermined position so as to be hermetically sealed.

8 Claims, 15 Drawing Sheets

U.S. PATENT DOCUMENTS

| | | | | | |
|---|---|---|---|---|---|
| 3,349,988 | A | * | 10/1967 | Horning | 229/249 |
| 4,394,954 | A | * | 7/1983 | Lisiecki | 229/249 |
| 5,067,613 | A | * | 11/1991 | Bryan | 229/214 |
| 5,474,232 | A | | 12/1995 | Ljungström et al. | |
| 5,725,147 | A | | 3/1998 | Ljungström et al. | |
| 5,803,349 | A | * | 9/1998 | Ljungstrom | 229/137 |
| 5,848,749 | A | | 12/1998 | Ljungström et al. | |
| 5,860,586 | A | * | 1/1999 | Anchor et al. | 229/213 |
| 5,860,588 | A | * | 1/1999 | Anchor | 229/137 |
| 5,871,144 | A | * | 2/1999 | Anchor et al. | 229/137 |
| 2006/0144912 | A1 | * | 7/2006 | Franic | 229/125.42 |

FOREIGN PATENT DOCUMENTS

| | | | |
|---|---|---|---|
| JP | 52-84440 | | 6/1977 |
| JP | 3-212340 | A * | 9/1991 |
| JP | 6-32315 | | 4/1994 |
| JP | 7-33820 | | 6/1995 |
| JP | 9-95328 | | 4/1997 |
| JP | 10-500085 | | 1/1998 |
| JP | 2002-234524 | | 8/2002 |

* cited by examiner

PAPER CONTAINER

TECHNICAL FIELD

The present invention relates to a paper container including a top of a gable roof type, the paper container containing a liquid to be drunk such as milk or juice.

BACKGROUND ART

Conventionally, as a paper container for a beverage typified by a milk carton, a paper container of a gable roof type (gable top type) has been widely used. The paper container of a gable roof type is formed of a board paper raw material having a top surface and a back surface laminated with thermoplastic resins. The paper container of a gable roof type includes four body portion panels. Edge portions of the paper container of a gable roof type are bonded with each other through a longitudinal-direction seal-panel, and thus a cylindrical (tubular) body portion having a square section is formed. Upper ends of the body portion panels are continuously provided with a pair of gable roof-forming panels and a pair of gable wall-forming panels. The pair of gable roof-forming panels includes exterior top seal panels at their tops and is opposed to each other. The pair of gable wall-forming panels includes interior top seal panels at their tops and is opposed to each other. Any one of the pair of gable wall-forming panels serves as a spout and is to be opened. Between the pair of gable roof-forming panels, the pair of gable wall-forming panels is folded inside. Each of the top seal panels is heated and sealed with each other at a predetermined position so as to be hermetically sealed. In this manner, a top of the paper container of a gable roof type is formed (for example, see Patent Document 1).

In such paper container of a gable roof type, if a seal width of a top seal portion to be formed by sealing the top seal panels with each other is large, when the heated and sealed opposed surfaces of the exterior top seal panel and the interior top seal panel on a side of the gable wall-forming panel, which serves as the spout upon opening of the spout, are separated from each other, strong force is required and it is difficult to open. Thus, as one of means for facilitating opening, the top seal portion is formed to have a small seal width as long as the sealing is not deteriorated.

Further, opening of the spout in the above-mentioned paper container of a gable roof type is performed in the following manner. Specifically, the heated and sealed opposed surfaces, of the exterior top seal panel and the interior top seal panel on the side of the gable wall-forming panel, which serves as the spout as described above, are separated from each other. Then, the gable wall-forming panel folded inside between the pair of gable roof-forming panels is pulled out. After that, the pulled out gable wall-forming panel is folded back from a top-portion lateral-fold-line to the exterior, the top-portion lateral-fold-line serving as a boundary between the body portion panels continuously provided via the top-portion lateral-fold-line. In this manner, the spout is opened. However, the spout thus opened and formed exhibits a rhomboid shape elongated in a lateral direction and has a small opening area of the spout. Besides, it is difficult to pour a liquid because the liquid flows out while spreading laterally.

Then, in order to obtain a spout through which pouring is easily performed, there has been proposed the following paper container. Specifically, in the paper container, a fold line for a spout is provided to extend in a perpendicular direction from a center of the gable wall-forming panel toward a body portion panel continuously provided. The gable wall-forming panel is folded inside between a pair of gable roof-forming panels. The gable wall-forming panel is pulled out between the pair of gable roof-forming panels. The gable wall-forming panel and the body portion panel are outwardly folded along the fold line for the spout. In this manner, the spout is formed (for example, see Patent Document 2).

According to the above-mentioned paper container, the spout thus opened and formed exhibits a rhomboid shape elongated in the longitudinal direction. Upon pouring, the liquid is guided in a spout direction by a V portion formed by the gable wall-forming panel and the body portion panel which are outwardly folded. The liquid is converged at the V portion of the spout, which has a downwardly-large depth. Therefore, the liquid is smoothly poured.

PRIOR ART DOCUMENT

Patent Document

[Patent Document 1]: Japanese Utility Model Application Laid-open No. Hei 06-32315

[Patent Document 2]: Japanese Utility Model Application Laid-open No. Hei 07-33820

However, in the paper container of a gable roof type disclosed in Patent Document 1, with a view to facilitating opening of the top seal portion, a seal width of the top seal portion is small. The top seal portion does not have a width enough to at least grasp the top seal portion. Therefore, for example, when one of paper containers arranged side by side in a refrigerator or on a shelf, it is difficult to pick up the paper container by grasping the top seal portion. Further, it is difficult to insert the fingers between the body portions of the paper containers adjacent to each other even when the body portion is grasped to be picked up. Consequently, picking up is difficult.

Further, in the paper container of a gable roof type disclosed in Patent Document 2, the fold line for the spout is provided to extend in the perpendicular direction from the center of the gable wall-forming panel toward the body portion panel continuously provided. The gable wall-forming panel is folded inside between the pair of gable roof-forming panels. The gable wall-forming panel is pulled out between the pair of gable roof-forming panels. The gable wall-forming panel and the body portion panel are outwardly folded along the fold line for the spout. In this manner, the spout is formed. Therefore, the spout thus opened and formed exhibits a rhomboid shape elongated in the longitudinal direction. In addition, there is a problem in that, due to the fold line for the spout, an angle, which is formed by the gable wall-forming panel and the body portion panel outwardly folded, is easy to be small (to be an acute angle) so that an opening area of the spout becomes smaller. In particular, when the body portion of the container is strongly grasped upon pouring, the gable wall-forming panel and the body portion panel are easy to be outwardly folded, and an outwardly-folding-angle, which is formed by outwardly folding the gable wall-forming panel and the body portion panel, is easy to be small (to be an acute angle) so that the spout thus formed exhibits a rhomboid shape more elongated in the longitudinal direction. As a result, there is a problem in that the opening area of the spout becomes smaller, a flow rate of the liquid becomes also smaller, and pouring is difficult. The present invention has been made for solving those problems.

An object of the present invention is therefore to provide a paper container including a top seal portion easy to be grasped without deteriorating capability of opening with ease of the top seal portion.

Another object of the present invention is to provide a paper container which allows a spout to be largely opened and with which a liquid is easy to be poured from the spout.

SUMMARY OF THE INVENTION

In order to achieve the above-mentioned objects, there is provided a paper container of a gable roof type formed of a board paper raw material having a top surface and a back surface laminated with thermoplastic resins, including four body portion panels. The paper container is configured so that edge portions of the paper container are bonded with each other through a longitudinal-direction seal-panel so as to form a cylindrical (tubular) body portion having a square section. Upper ends of the body portion panels are continuously provided with a pair of gable roof-forming panels, including exterior top seal panels at the tops of the gable roof-forming panels and being opposed to each other, and provided with a pair of gable wall-forming panels, including interior top seal panels at the tops of the gable wall-forming panels and being opposed to each other. One of the pair of gable wall-forming panels serves as a spout and is to be opened. The pair of gable wall-forming panels is folded inside between the pair of gable roof-forming panels, and the exterior top seal panels and the interior top seal panels are heated and sealed with each other at a predetermined position so as to be hermetically sealed, to thereby form a top of the paper container. A seal width on a non-opening side of a top seal portion, which is formed by heating and sealing the exterior top seal panels and the interior top seal panels with each other at the predetermined position, is larger than a seal width on an opening side serving as the spout, the seal width being downwardly enlarged from the opening side to the non-opening side. Top-portion lateral-fold-lines serving as boundaries between the pair of gable roof-forming panels and the body portion panels are downwardly tilted from the opening side to the non-opening side.

Seal lateral fold lines serving as boundaries between the exterior top seal panels determining the seal width of the top seal portion, and the pair of gable roof-forming panels are shaped into straight lines which are downwardly tilted from the opening side to the non-opening side. The top-portion lateral-fold-lines serving as the boundaries between the pair of gable roof-forming panels and the body portion panels are shaped into straight lines which are tilted generally in parallel to the seal lateral fold lines.

Seal lateral fold lines serving as boundaries between the exterior top seal panels determining the seal width of the top seal portion, and the pair of gable roof-forming panels are shaped into straight lines which horizontally extend from the opening side to a substantially central position, and which are downwardly tilted from the substantially central position toward the non-opening side. The top-portion lateral-fold-lines serving as the boundaries between the pair of gable roof-forming panels and the body portion panels are shaped into straight lines each generally in parallel to a line linking an end portion on the opening side and an end portion on the non-opening side of each of the seal lateral fold lines.

Seal lateral fold lines serving as boundaries between the exterior top seal panels determining the seal width of the top seal portion, and the pair of gable roof-forming panels are shaped into upwardly curved lines which are downwardly tilted from the opening side to the non-opening side. The top-portion lateral-fold-lines serving as the boundaries between the pair of gable roof-forming panels and the body portion panels are shaped into upwardly curved lines which are tilted generally in parallel to the seal lateral fold lines.

One of the body portion panels, which is continuously provided via a top-portion lateral-fold-line to a gable wall-forming panel on the opening side, is provided with a first auxiliary fold line, which is shaped into a downwardly curved line, traverses the body portion panel, and merges into body-portion longitudinal-fold-lines on both sides of the body portion panel or a vicinity thereof. The portion panel is provided with second auxiliary fold lines, which extend, respectively, from both ends of the first auxiliary fold line or a vicinity thereof toward a seal-side vertex of a substantially triangular surface of the gable wall-forming panel on the opening side and which merges into the top-portion lateral-fold-lines or a vicinity thereof, the seal-side vertex being formed by being folded inside between the pair of gable roof-forming panels.

The second auxiliary fold lines can be shaped into inwardly curved lines with respect to each other.

The substantially triangular surface of the gable wall-forming panel on the opening side is provided with third auxiliary fold lines on extensions of the second auxiliary fold lines.

The one of the body portion panels, which is continuously provided to the one of the pair of gable roof-forming panels, is provided with a fourth auxiliary fold line in such a manner that a protruding tip end of a curved-line of the fourth auxiliary fold line is held, on a lower side of the first auxiliary fold line in a vicinity thereof, in contact with a protruding tip end of a curved-line of the first auxiliary fold line. The fourth auxiliary fold line is shaped into an upwardly curved line which traverses the one of the body portions panel and merges into the body-portion longitudinal-fold-lines on the both sides of the one of the body portion panels or the vicinity thereof.

EFFECTS OF THE INVENTION

According to the paper container of the present invention, the seal width on the non-opening side of the top seal portion, which is formed by heating and sealing the exterior top seal panels and the interior top seal panels with each other at the predetermined position, is larger than the seal width on the opening side serving as the spout, the seal width on the non-opening side being downwardly enlarged. Thus, it is possible to maintain a narrow seal width for facilitating opening of the top seal portion on the opening side serving as the spout. At the same time, it is possible to easily grasp the seal portion on the non-opening side because the seal width on the non-opening side is large. For example, when one of paper containers arranged side by side in a refrigerator or on a shelf is tried to be picked up, it is possible to easily pick up the paper container by grasping the top seal portion. Further, on the non-opening side of the top seal portion, the seal width is large, and hence strength thereof is increased. Depending on needs, punching processing of the top seal portion is allowed.

Further, the top-portion lateral-fold-lines, which serve as boundaries between the pair of gable roof-forming panels and the body portion panels, are downwardly tilted from the opening side toward the non-opening side. The above-mentioned tilting corresponds to the seal lateral fold lines serving as boundaries between the exterior top seal panels, which determine the seal width of the top seal portion, and the pair of gable roof-forming panels, respectively. Thus, a large area of the gable roof-forming panels can be obtained, and hence a printing area is also large. Further, whether the paper container is displayed in an upright (standing) state or in a laid state, visibility of a print-indicating part in the pair of gable roof-forming panels can be promoted.

Further, due to the shape of the top, it is possible to further bear load in the longitudinal direction in comparison with a top of the conventional paper container. The top of the conventional paper container has the following structure. Specifically, in the structure, a seal width of the top seal portion is constant, and a top-portion lateral-fold-line, which serves as a boundary between a pair of gable roof-forming panels and a body portion panel, is parallel to a seal lateral fold line, which serves as a boundary between exterior top seal panels and a pair of gable roof-forming panels.

According to the paper container of the present invention, the seal lateral fold lines serving as boundaries between the exterior top seal panels determining the seal width of the top seal portion, and the pair of gable roof-forming panels are shaped into the straight lines which are downwardly tilted from the opening side to the non-opening side. The top-portion lateral-fold-lines serving as the boundaries between the pair of gable roof-forming panels and the body portion panels are shaped into the straight lines which are tilted generally in parallel to the seal lateral fold lines. Thus, load capacity of the top in the longitudinal direction is promoted.

According to the paper container of the present invention, the seal lateral fold lines serving as boundaries between the exterior top seal panels determining the seal width of the top seal portion, and the pair of gable roof-forming panels are shaped into the straight lines which horizontally extend from the opening side to the substantially central position, and which are downwardly tilted from the substantially central position to the non-opening side. Thus, the seal width of the top seal portion is the same from the opening side to the substantially central position, and hence a more stable seal state can be obtained.

According to the paper container of the present invention, the seal lateral fold lines serving as boundaries between the exterior top seal panels determining the seal width of the top seal portion, and the pair of gable roof-forming panels are shaped into the upwardly curved lines which are downwardly tilted from the opening side to the non-opening side. Thus, a foldout stress of the gable wall-forming panels is reduced by the seal lateral fold lines which are shaped into the curved line, the foldout stress being applied to the pair of gable wall-forming panels when the pair of gable wall-forming panels is folded inside between the pair of gable roof-forming panels. As a result, a more stable seal state can be obtained.

Further, the top-portion lateral-fold-lines serving as boundaries between the pair of gable roof-forming panels and the body portion panels are shaped into the upwardly curved lines which are tilted generally in parallel to the seal lateral fold lines. Thus, when the body portion is grasped and held, the body portion being continuously provided to the pair of gable roof-forming panels of the paper container which is opened by separating the opposed surfaces from each other, which are heated and sealed along the exterior top seal panels and the interior top seal panels on a side of the pair of gable wall-forming panels situating on the opening side, the body portion panels are deformed so as to be an inwardly curved surface by the top-portion lateral-fold-lines which are formed into upwardly curbed lines. As a result, the corner portions on the non-opening side are posed in a state in which the corner portions correspondingly protrude. Therefore, the corner portions are hooked with the fingers grasping the body portion, and hence it is easy to hold.

According to the paper container of the present invention, the body portion panel, which is continuously provided to the gable wall-forming panel on the opening side via the top-portion lateral-fold-line, is provided with the first auxiliary fold line which is shaped into the downwardly curved line, traverses the body portion panel, and merges into the body-portion longitudinal-fold-lines on the both sides of the body portion panel or the vicinity thereof, and is provided with the second auxiliary fold lines, which extend, respectively, from the both ends of the first auxiliary fold line or the vicinity thereof toward the seal-side vertex of the substantially triangle surface of the gable wall-forming panel and merges into the top-portion lateral-fold-lines or the vicinity thereof, the seal-side vertex being formed by being folded inside between the pair of gable wall-forming panels. Thus, for opening of the spout, the gable wall-forming panel folded inside between the pair of gable roof-forming panels is pulled out. Then, force is applied on the corner portions on the both sides of the boundary between the gable wall-forming panel and the body portion panel in such a manner that the corner portions are sandwiched from the both sides of the top-portion lateral-fold-line. As a result, the body portion panel is guided by the first auxiliary fold line shaped into the downwardly curved line. Then, the body portion panel is inwardly folded along the first auxiliary fold line. In this case, the body portion panel is inwardly folded along the first auxiliary fold line shaped into the downwardly curved line. At the same time, the body portion panel is outwardly folded along the second auxiliary fold lines. In this manner, the body portion panel on the upper side of the first auxiliary fold line protrudes in a substantially flat boat-bottom shape. Then, due to the fact that the body portion panel is outwardly folded along the second auxiliary fold lines, the substantially triangle surface of the gable wall-forming panel is also outwardly folded along the extensions of the second auxiliary fold lines toward the seal-side vertex. In this manner, the substantially triangular surface of the gable wall-forming panel protrudes in the boat-bottom shape continuous with the body portion panel. As a result, the spout is opened. The spout, which is opened as described above, exhibits a rhomboid shape slightly elongated in the longitudinal direction. Consequently, the spout is largely opened, and hence it is possible to increase the flow rate of the liquid.

Further, even when the body portion of the container is strongly grasped upon pouring, a substantially flat surface of a boat-bottom shaped portion is hardly folded and the opening shape of the spout is hardly changed or changed little, if changed at all. That is because the body portion panel on the upper side of the first auxiliary fold line and the substantially triangle surface of the gable wall-forming panel protrude in the substantially flat boat-bottom shape.

According to the paper container of the present invention, the second auxiliary fold lines are shaped into the inwardly curved lines with respect to each other. Thus, when force is applied on corner portions on both sides of the boundary between the gable wall-forming panel and the body portion panel in such a manner that the corner portions are sandwiched from the both sides of the top-portion lateral-fold-line, the body portion panel is guided by the second auxiliary fold lines which are shaped into the inwardly curved lines with respect to each other. Then, the body portion panel is outwardly folded along the second auxiliary fold lines. Thus, it is possible to easily cause the body portion panel on the upper side of the first auxiliary fold line to protrude in the substantially flat boat-bottom shape.

According to the paper container of the present invention, the substantially triangular surface of the gable wall-forming panel on the opening side is provided with third auxiliary fold lines on the extensions of the second auxiliary fold lines. Thus, when force is applied on the corner portions on both sides of the boundary between the gable wall-forming panel and the body portion panel in such a manner that the corner portions are sandwiched from both sides of the top-portion lateral-fold-line, the body portion panel is outwardly folded along the second auxiliary fold lines. Due to folding as described above, the substantially triangle surface of the gable wall-forming panel is also outwardly folded along the third auxiliary fold lines on the extensions of the second auxiliary fold lines. Thus, it is possible to easily cause the substantially triangle surface of the gable wall-forming panel to protrude in the boat-bottom shape continuous with the body portion panel.

According to the paper container of the present invention, the body portion panel which is continuously provided to the gable wall-forming panel, is provided with the fourth auxiliary fold line in such a manner that the protruding tip end of the curved-line of the fourth auxiliary fold line is held, on the lower side of the first auxiliary fold line, in contact with the protruding tip end of the curved-line of the first auxiliary fold line or a vicinity thereof, the fourth auxiliary fold line being shaped into an upwardly curved line which traverses the body portion panel and merges into the body-portion longitudinal-fold-lines on the both sides of the body portion panel or the vicinity thereof. Thus, when force is applied on the corner portions on the both sides of the boundary between the gable wall-forming panel and the body portion panel in such a manner that the corner portions are sandwiched from the both sides of the top-portion lateral-fold-line, the body portion panel is easily and certainly inwardly folded along first auxiliary fold line shaped into the downwardly curved line.

DETAILED DESCRIPTION OF THE INVENTION

Figure 1:
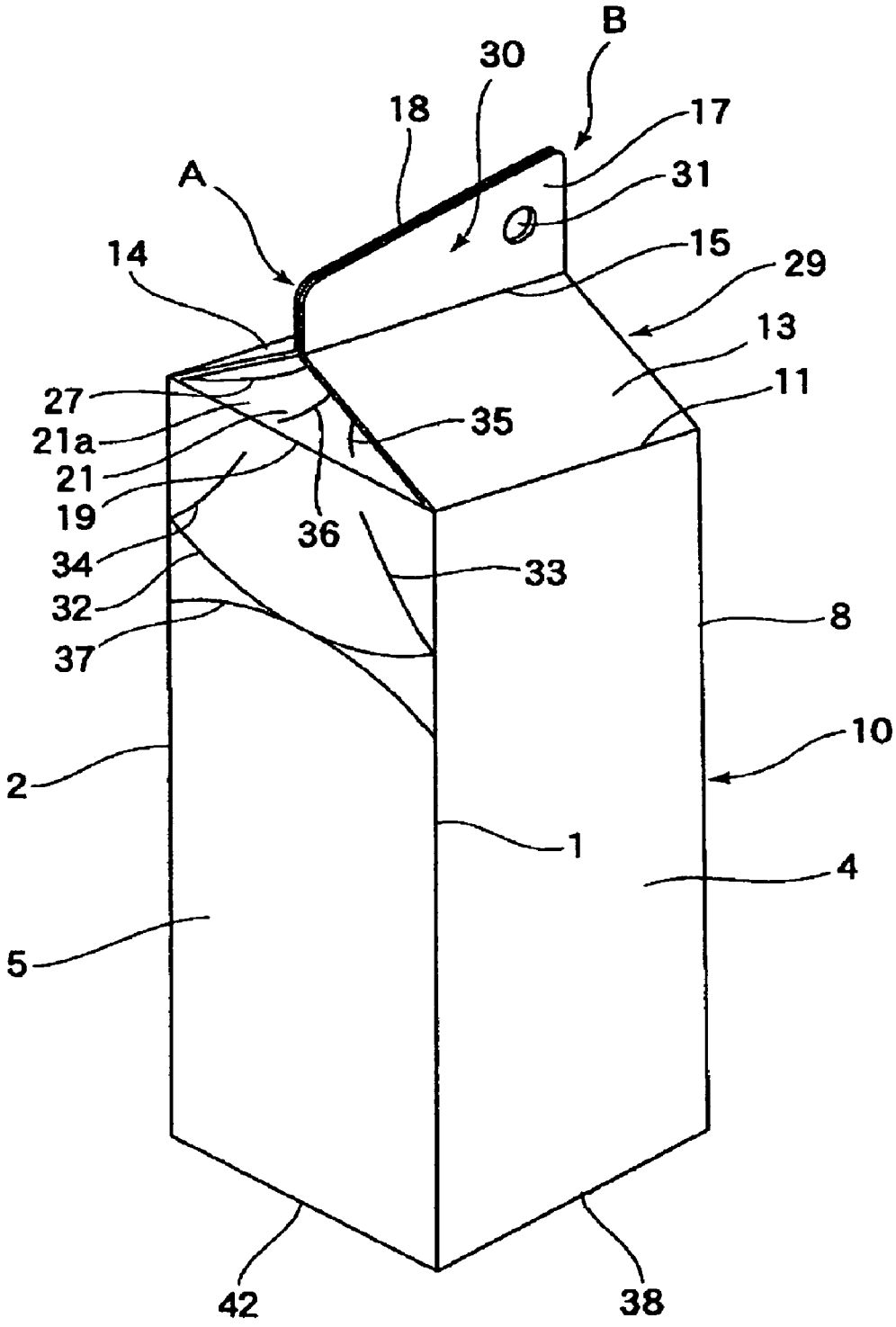
FIG. 1 A perspective view illustrating a paper container according to a first embodiment of the present invention.

In the following, various modes of a paper container according to the present invention are described in detail by way of examples illustrated in the drawings.

Figure 2:
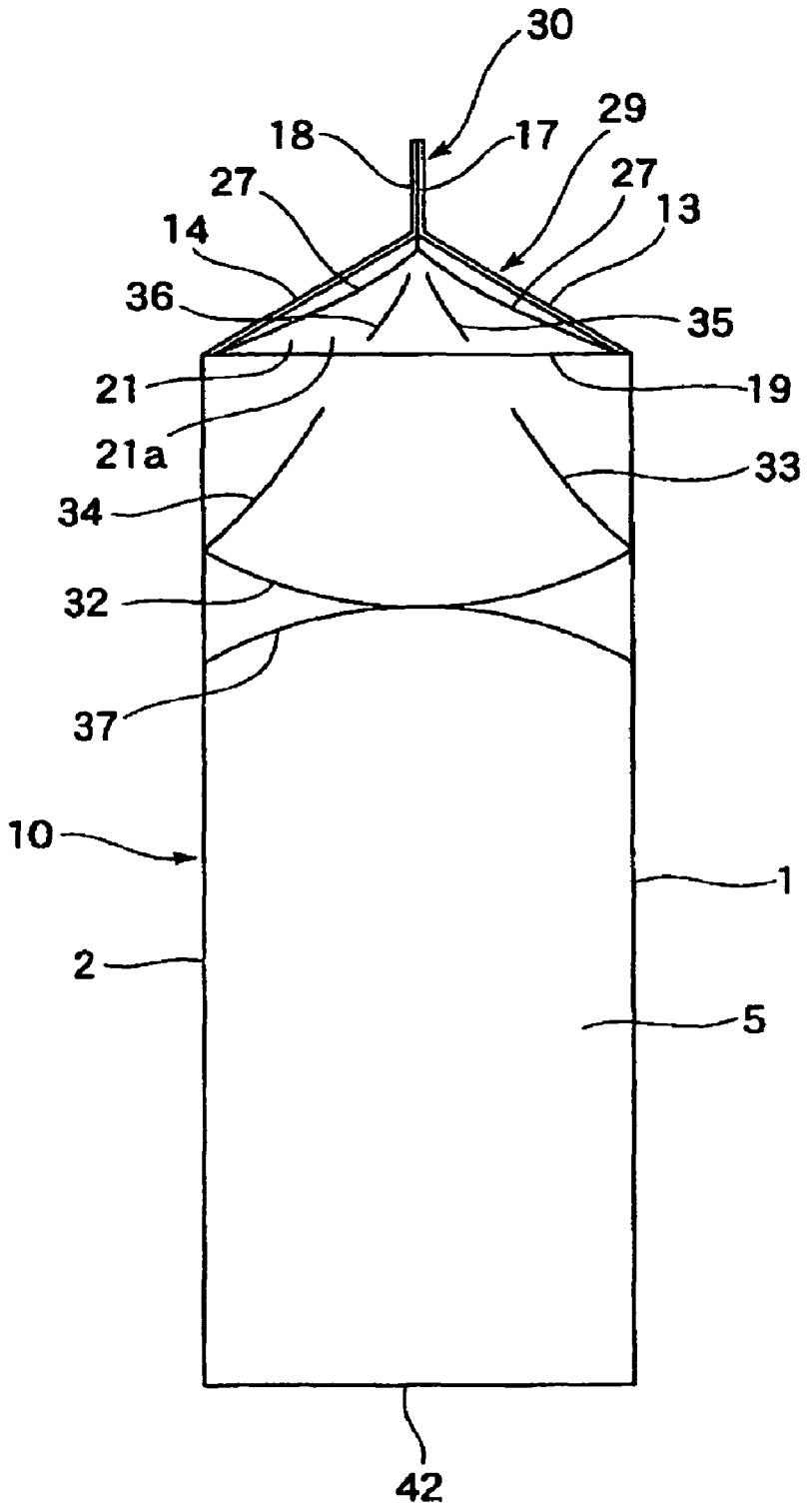
FIG. 2 A front view of the paper container illustrated in FIG. 1.
Figure 3:
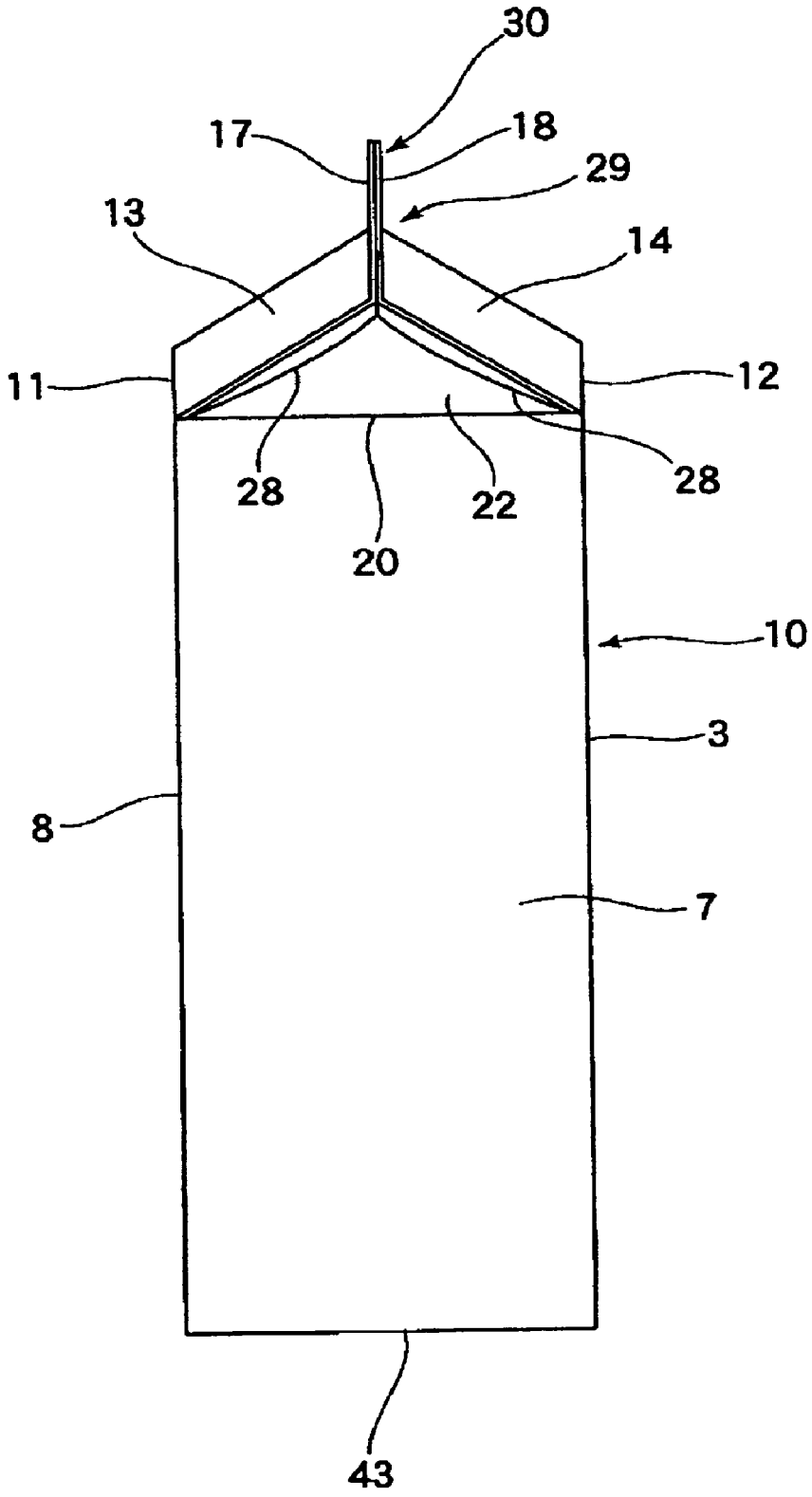
FIG. 3 A back view of the paper container illustrated in FIG. 1.
Figure 4:
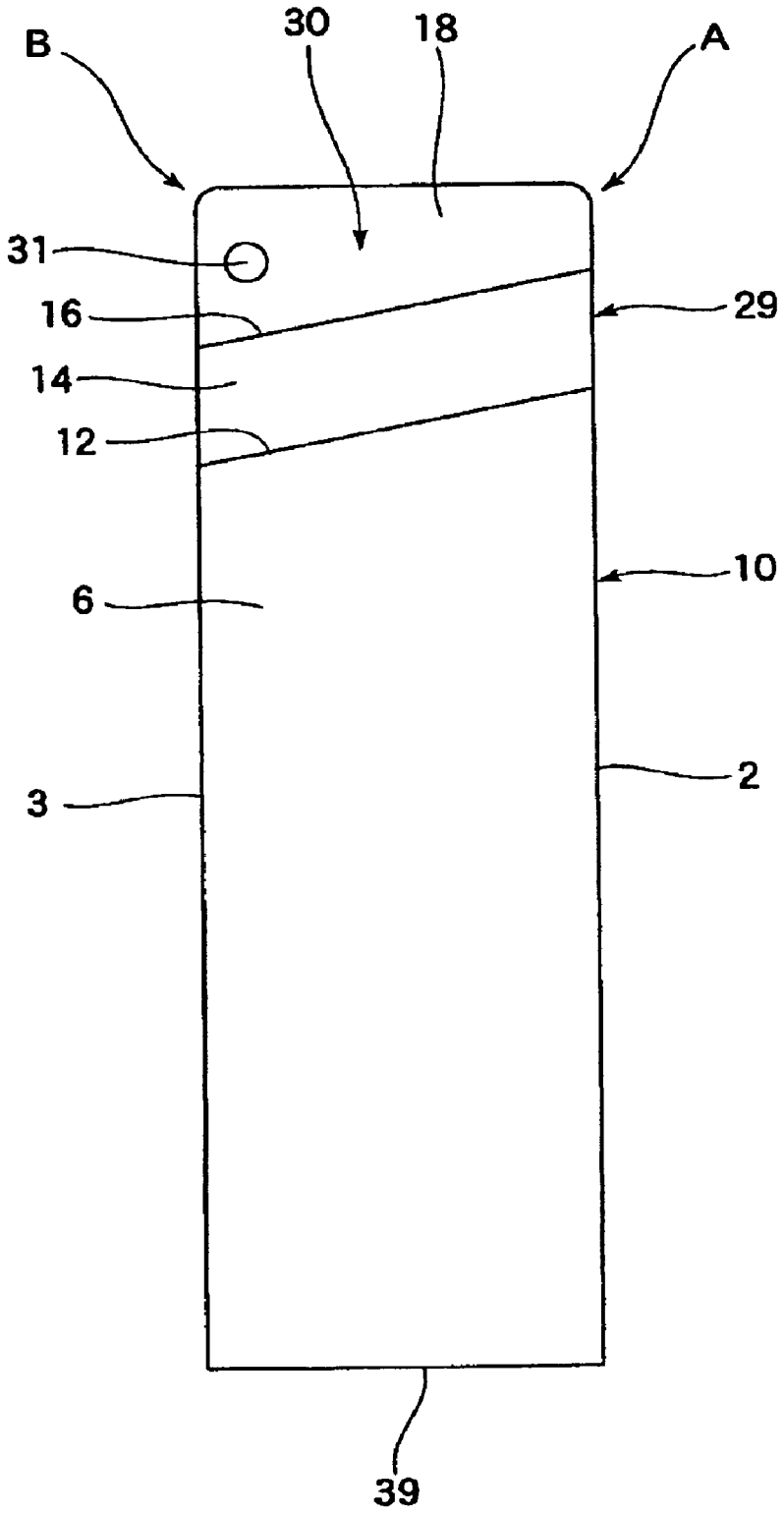
FIG. 4 A side view of the paper container illustrated in FIG. 1.
Figure 5:
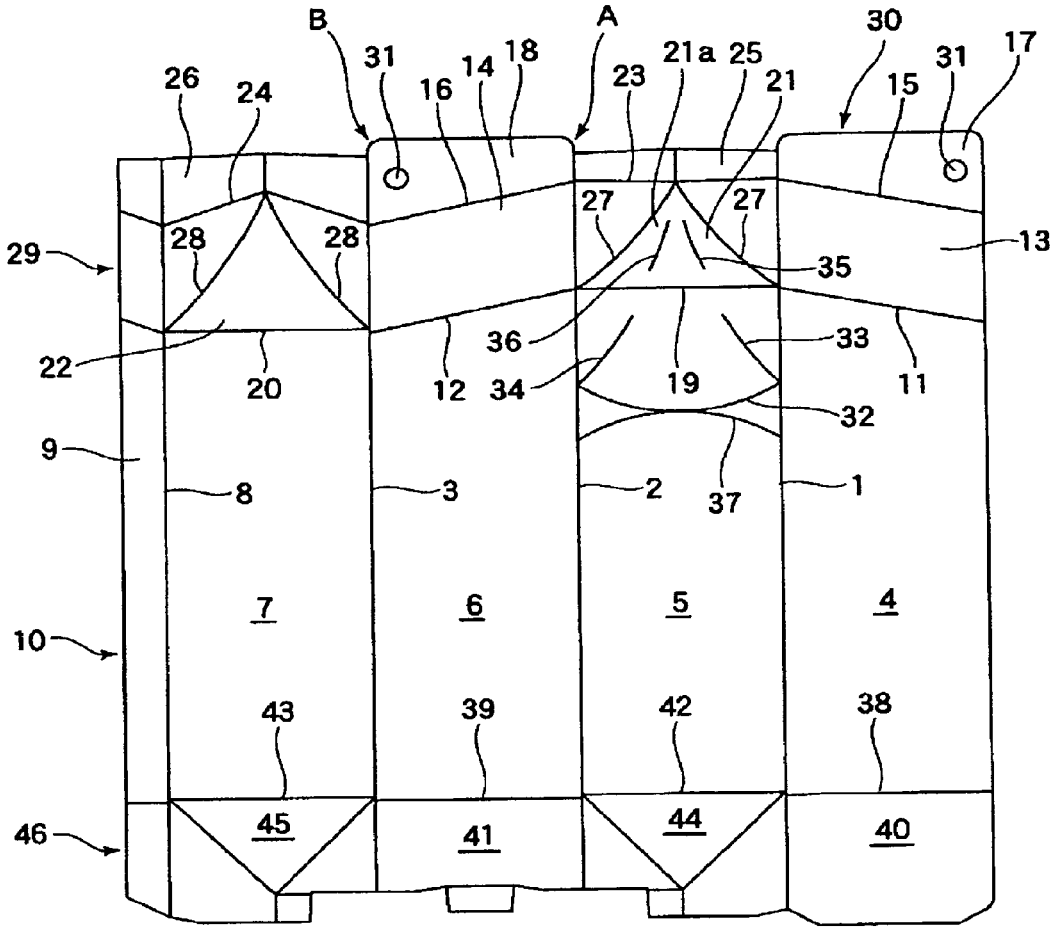
FIG. 5 A development view illustrating a carton blank before erection processing of the paper container illustrated in FIG. 1.
Figure 6:
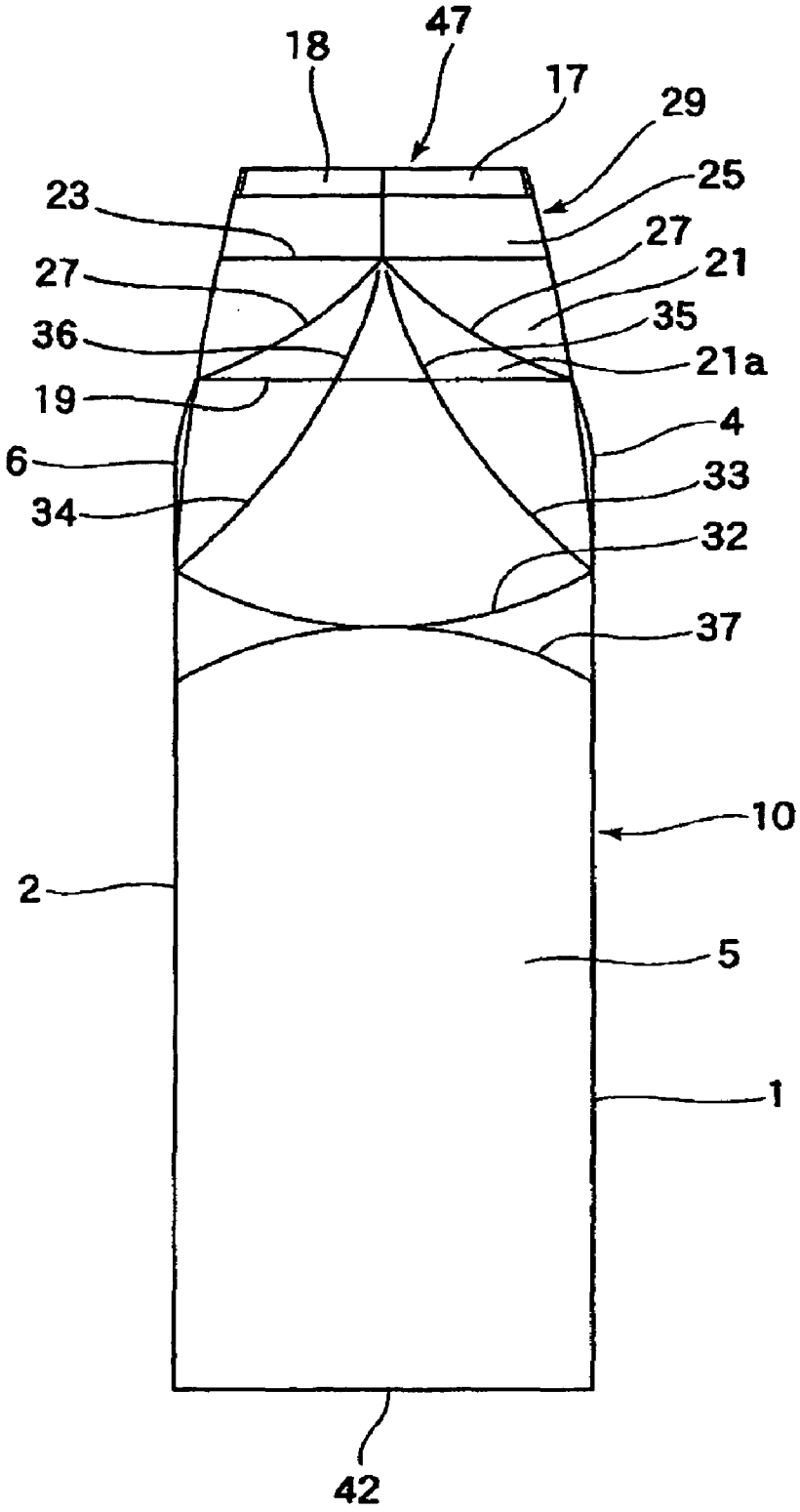
FIG. 6 A front view illustrating a state in which the paper container illustrated in FIG. 1 is opened.
Figure 7:
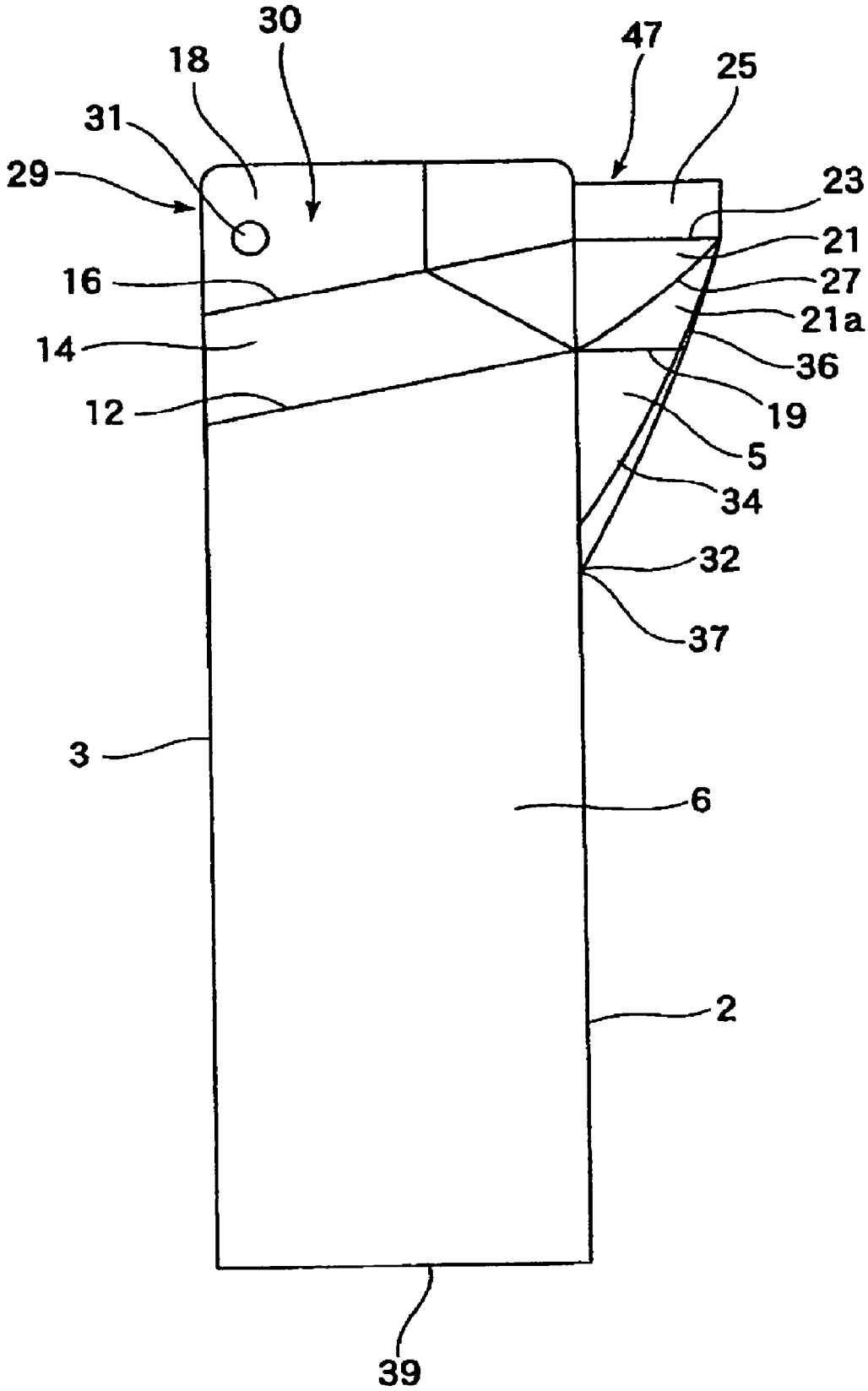
FIG. 7 A side view illustrating the state in which the paper container illustrated in FIG. 1 is opened.
Figure 8:
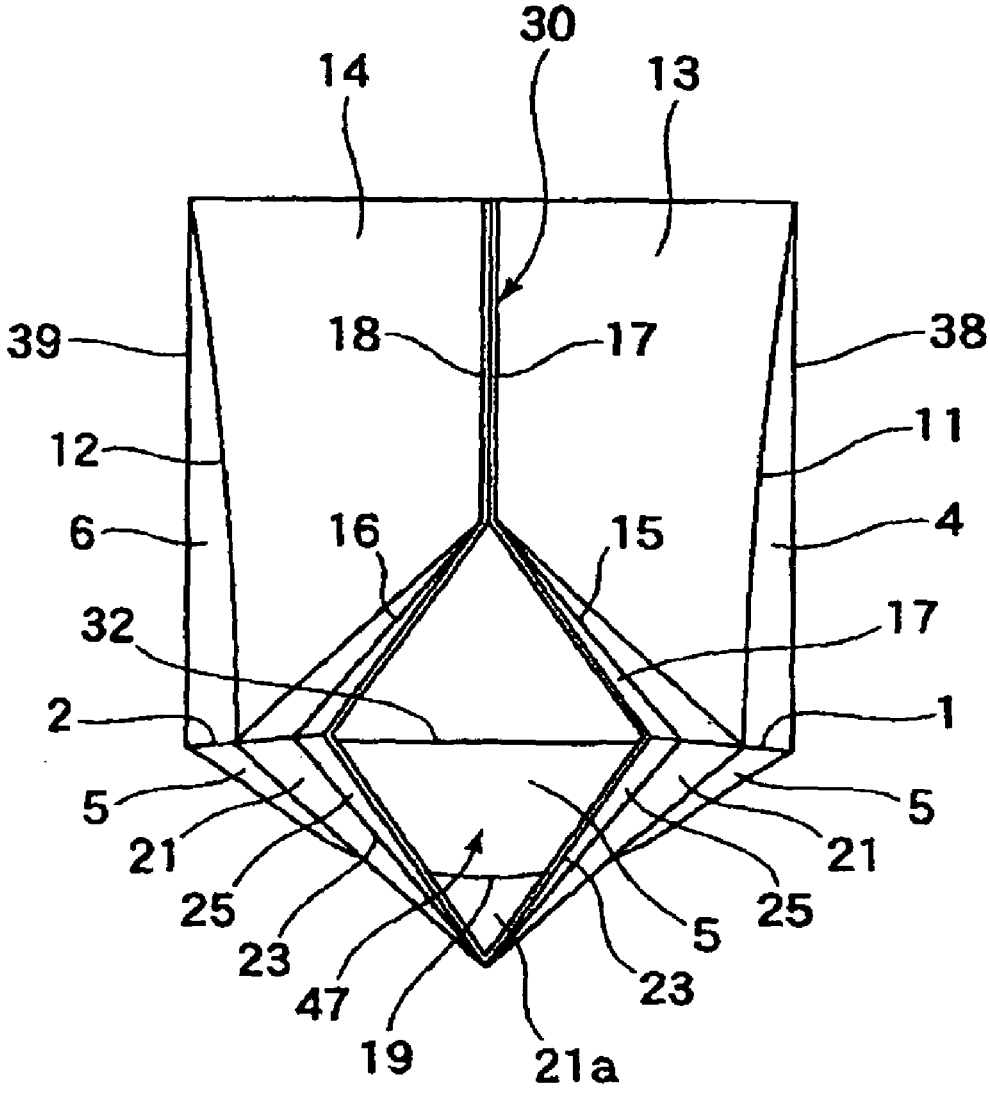
FIG. 8 A plan view illustrating the state in which the paper container illustrated in FIG. 1 is opened.
Figure 9:
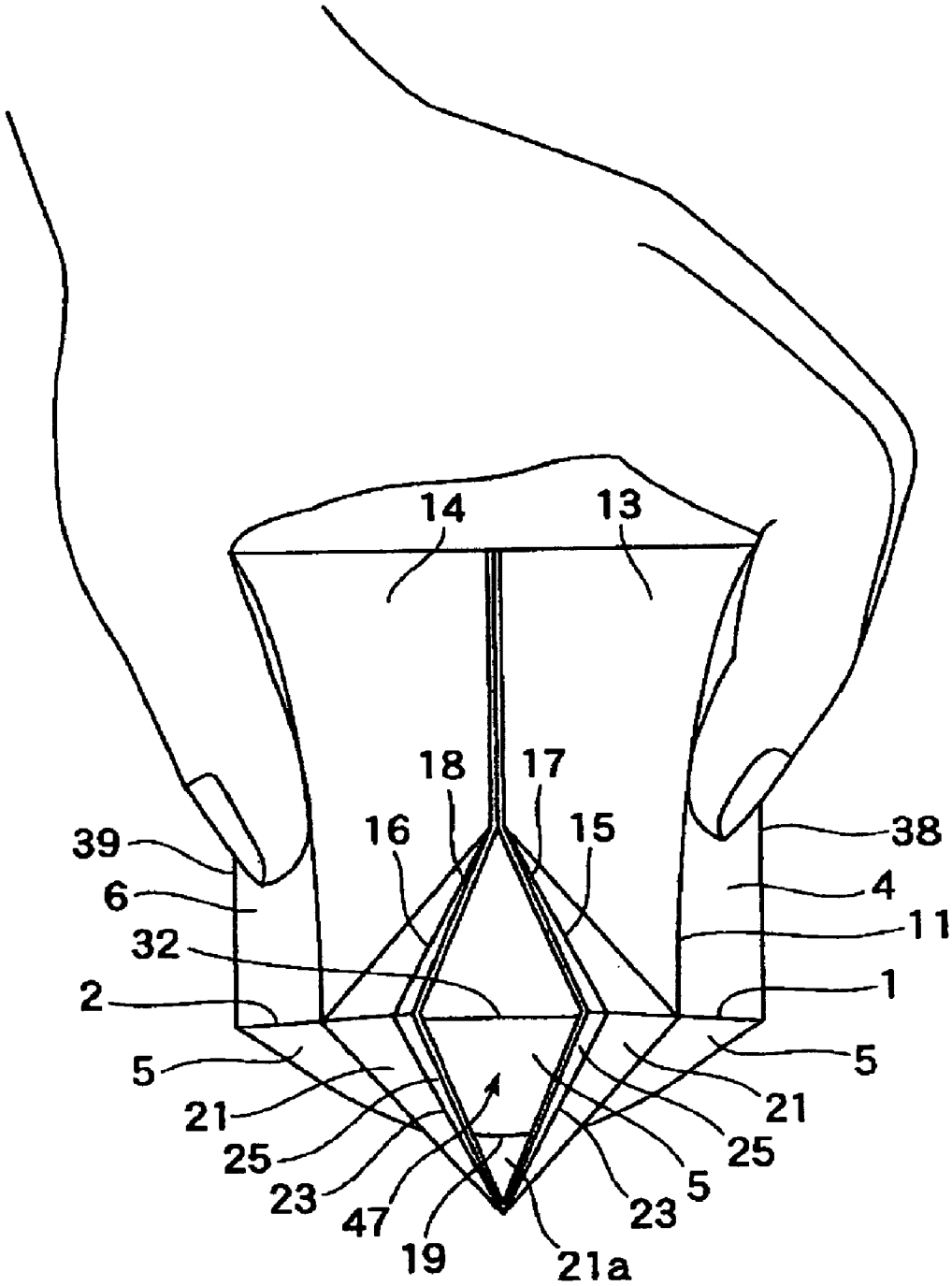
FIG. 9 An explanation view illustrating a state in which the opened paper container is grasped.

FIGS. 1 to 9 illustrate a paper container according to a first embodiment of the present invention. FIG. 1 is a perspective view illustrating the paper container according to this embodiment. FIG. 2 is a front view of the paper container illustrated in FIG. 1. FIG. 3 is a back view of the paper container illustrated in FIG. 1. FIG. 4 is a side view of the paper container illustrated in FIG. 1. FIG. 5 is a development view illustrating a carton blank before erection processing of the paper container illustrated in FIG. 1. FIG. 6 is a front view illustrating a state in which the paper container illustrated in FIG. 1 is opened. FIG. 7 is a side view illustrating the state in which the paper container illustrated in FIG. 1 is opened. FIG. 8 is a plan view illustrating the state in which the paper container illustrated in FIG. 1 is opened. FIG. 9 is an explanation view illustrating a state in which the opened paper container is grasped.

The paper container according to this embodiment is formed of a board paper raw material having a top surface and a back surface laminated with thermoplastic resins. The paper container includes four body portion panels 4, 5, 6, and 7 via body-portion longitudinal-fold-lines 1, 2, and 3. Edge portions of the paper container are bonded with each other through a longitudinal-direction seal-panel 9 which is continuously provided to the body portion panel 7 via a seal longitudinal fold line 8. In this manner, a cylindrical (tubular) body portion 10 having a square section is formed.

Upper ends of the body portion panels 4 and 6, which are opposed to each other, of the tubular body portion 10, are continuously provided with a pair of gable roof-forming panels 13 and 14 which are opposed to each other via top-portion lateral-fold-lines 11 and 12. Upper portions of the pair of gable roof-forming panels 13 and 14 are continuously provided with exterior top seal panels 17 and 18 via seal lateral fold lines 15 and 16. Further, upper ends of the other body portion panels 5 and 7, which are opposed to each other, of the cylindrical (tubular) body portion 10, are continuously provided with a pair of gable wall-forming panels 21 and 22 which are opposed to each other via top-portion lateral-fold-lines 19 and 20. One of the pair of gable wall-forming panels 21 and 22 serves as a spout and is to be opened. Upper portions of the pair of gable wall-forming panels 21 and 22 are continuously provided with interior top seal panels 25 and 26 via seal lateral fold lines 23 and 24.

Further, the pair of gable wall-forming panels 21 and 22 is provided with foldout lines 27 and 28. The foldout lines 27 and 28 extend from both ends of the top-portion lateral-fold-lines 19 and 20 serving as boundaries between the pair of gable wall-forming panels 21 and 22 and the body portion panels 5 and 7, respectively. The foldout lines 27 and 28 merge into a center of seal lateral fold lines 23 and 24 serving as boundaries between the pair of gable wall-forming panels 21 and 22 and the interior top seal panels 25 and 26, respectively. The pair of gable wall-forming panels 21 and 22 is folded at the foldout lines 27 and 28, respectively, and hence the pair of gable wall-forming panels 21 and 22 is folded inside between the pair of gable roof-forming panels 13 and 14. Then, the exterior top seal panels 17 and 18 and the interior top seal panels 25 and 26 are heated and sealed at a predetermined position so as to be hermetically sealed. In this manner, a top 29 of a gable roof type is formed.

In a top seal portion 30 formed by sealing the exterior top seal panels 17 and 18 and the interior top seal panels 25 and 26 with each other, its seal width (longitudinal direction) on a non-opening side B is larger than that on an opening side A serving the spout, the seal width on the non-opening side B being downwardly enlarged. More specifically, the seal width on the opening side A, which serves as the spout of the top seal portion 30, is set to be small as long as the sealing is not deteriorated. In contrast, the seal width on the non-opening side B is set to be downwardly enlarged at least enough to be grasped.

In this embodiment, the seal lateral fold lines 15 and 16, which serve as boundaries between the exterior top seal panels 17 and 18 determining the seal width of the top seal portion 30, and the pair of gable roof-forming panels 13 and 14, are shaped into straight lines which are downwardly tilted from the opening side A toward the non-opening side B. Further, a large-width surface on the non-opening side B of the top seal portion 30 is provided with a hole 31 for suspension.

Further, the top-portion lateral-fold-lines 11 and 12, which serve as boundaries between the pair of gable roof-forming panels 13 and 14 and the body portion panels 4 and 6, are downwardly tilted from the opening side A toward the non-opening side B. The above-mentioned tilting is corresponding to the seal lateral fold lines 15 and 16 serving as boundaries between the exterior top seal panels 17 and 18 determining the seal width of the top seal portion 30, and the pair of gable roof-forming panels 13 and 14.

In this embodiment, the top-portion lateral-fold-lines 11 and 12, which serve as boundaries between the pair of gable roof-forming panels 13 and 14 and the body portion panels 4 and 6, are shaped into straight lines which are tilted generally in parallel to the seal lateral fold lines 15 and 16, respectively.

Further, in this embodiment, the foldout lines 27 and 28 provided to the pair of gable wall-forming panels 21 and 22 are shaped into downwardly curved lines which extend to the top-portion lateral-fold-lines 19 and 20, respectively.

Further, the body portion panel 5, which is continuously provided to the gable wall-forming panel 21 on the opening side A via the top-portion lateral-fold-line 19, is provided with a first auxiliary fold line 32 shaped into a downwardly curved line. The first auxiliary fold line 32 traverses the body portion panel 5 and merges into the body-portion longitudinal-fold-lines 1 and 2 on the both sides of the body portion panel 5 or the vicinity thereof. A position at which the body portion panel 5 is provided with the first auxiliary fold line 32 is not particularly limited. However, it is preferred that the position be lowered from the top-portion lateral-fold-line 19 by a length corresponding to a longitudinal width of the gable wall-forming panel 21. By providing the first auxiliary fold line 32 at such position, to be described later in detail, upon opening of the spout, the spout is largely opened at a maximum degree when the pair of gable wall-forming panel 21, which is folded inside between the pair of gable roof-forming panels 13 and 14, is pulled out so as to be opened.

In addition, the body portion panel 5 is provided with second auxiliary fold lines 33 and 34. The second auxiliary fold lines 33 and 34 extend, respectively, from both ends of the first auxiliary fold line 32 or the vicinity thereof toward a seal-side vertex or merge into the top-portion lateral-fold-line 19 or the vicinity thereof. The seal-side vertex of a substantially triangular surface 21*a* of the gable wall-forming panel 21 is formed by being folded inside between the pair of gable roof-forming panels 13 and 14. The second auxiliary fold lines 33 and 34 are shaped into inwardly curved lines with respect to each other in this embodiment.

Further, in this embodiment, the substantially triangular surface 21*a* of the gable wall-forming panel 21 is provided with third auxiliary fold lines 35 and 36 on the extensions of the second auxiliary fold lines 33 and 34. The third auxiliary fold lines 35 and 36 are also shaped into inwardly curved lines with respect to each other similarly to the second auxiliary fold lines 33 and 34.

Further, in this embodiment, the body portion panel 5 continuously provided to the gable wall-forming panel 21 is provided with a fourth auxiliary fold line 37 shaped into an upwardly curved line in such a manner that a protruding tip end of the curved-line or the vicinity of the protruding tip end of the fourth auxiliary fold line 37 is held, on a lower side of the first auxiliary fold line 32, in contact with the protruding tip end of the curved-line of the first auxiliary fold line 32. The fourth auxiliary fold line 37 traverses the body portion panel 5 and merges into the body-portion longitudinal-fold-lines 1 and 2 on the both sides of the body portion panel 5 or the vicinity thereof.

Note that, lower ends of the body portion panels 4 and 6, which are opposed to each other, of the tubular body portion 10 are continuously provided with a pair of exterior panels 40 and 41. The pair of exterior panels 40 and 41 are opposed to each other via bottom-portion lateral-fold-lines 38 and 39. Lower ends of the other body portion panels 5 and 7, which are opposed to each other, of the tubular body portion 10 are continuously provided with a pair of interior panels 44 and 45 via bottom-portion lateral-fold-lines 42 and 43. The pair of interior panels 44 and 45 is folded inside between the pair of exterior panels 40 and 41. Then, the pair of interior panels 44 and 45 and the pair of exterior panels 40 and 41 are heated and sealed so as to be hermetically sealed. In this manner, a bottom portion 46 is formed.

In the paper container according to the first embodiment constituted as described above, the seal width on the non-opening side B of the top seal portion 30, which is formed by heating and sealing the exterior top seal panels 17 and 18 and the interior top seal panels 25 and 26 at a predetermined position, is larger than that on the opening side A serving the spout, the seal width on the non-opening side B being downwardly enlarged. Thus, it is possible to maintain a narrow seal width for facilitating opening of the top seal portion 30 on the opening side A serving as the spout. At the same time, it is possible to easily grasp the top seal portion 30 because the seal width on the non-opening side B is large.

Further, the top-portion lateral-fold-lines 11 and 12 serving as boundaries between the pair of gable roof-forming panels 13 and 14 and the body portion panels 4 and 6 are downwardly tilted from the opening side A toward the non-opening side B. The above-mentioned tilting is corresponding to the seal lateral fold lines 15 and 16 serving as boundaries between the exterior top seal panels 17 and 18 determining the seal width of the top seal portion 30, and the pair of gable roof-forming panels 13 and 14. Thus, it is possible to obtain a large area of the pair of gable roof-forming panels 13 and 14, and hence a printing area can be also large. Further, regardless of whether the paper container is displayed in an upright state or in a laid state, good visibility of a print-indicating part in the pair of gable roof-forming panels 13 and 14 can be obtained.

Further, the top 29 in this embodiment, which has the above-mentioned shape, is capable of further bearing load in the longitudinal direction in comparison with a shape of a top of the conventional paper container. The top of the conventional paper container has the following structure. Specifically, in the structure, a seal width of the top seal portion is constant, and top-portion lateral-fold-lines serving as boundaries between a pair of gable roof-forming panels and body portion panels are parallel to seal lateral fold lines serving as boundaries between exterior top seal panels and a pair of gable roof-forming panels.

In particular, in this embodiment, the seal lateral fold lines 15 and 16, which serve as boundaries between the exterior top seal panels 17 and 18 determining the seal width of the top seal portion 30, and the pair of gable roof-forming panels 13 and 14, are shaped into the straight lines which are downwardly tilted from the opening side A toward the non-opening side B. Further, the top-portion lateral-fold-lines 11 and 12 serving as boundaries between the pair of gable roof-forming panels 13 and 14 and the body portion panels 4 and 6 are shaped into the straight lines which are tilted generally in parallel to the seal lateral fold lines 15 and 16, respectively. Thus, significant strength with respect to load in the longitudinal direction at the top 29 can be obtained.

Further, in this embodiment, the foldout lines 27 and 28 provided to the pair of gable wall-forming panels 21 and 22 are shaped into downwardly curved lines which extend to the top-portion lateral-fold-lines 19 and 20, respectively. As a result, both inner sides of folded-inside-portions of the gable wall-forming panels 21 and 22, which are folded inside between the pair of gable roof forming panels 13 and 14, are to be protruding-curved-surfaces. Thus, upon opening, it is easy to grasp the paper container with fingers, and hence it is easy to open.

Further, for opening of the spout, the gable wall-forming panel 21 folded inside between the pair of gable roof-forming panels 13 and 14 is pulled out. Then, force is applied on the corner portions on the both sides of the boundary between the gable wall-forming panel 21 and the body portion panel 5 in such a manner that the corner portions are sandwiched from the both sides of the top-portion lateral-fold-line 19. As a result, the body portion panel 5 is guided by the first auxiliary fold line 32 shaped into the downwardly curved line. Then, the body portion panel 5 is inwardly folded along the first auxiliary fold line 32. In this case, the body portion panel 5 is easily and certainly inwardly folded along the first auxiliary fold line 32 shaped into the downwardly curved line. That is because, in this embodiment, the body portion panel 5 is provided with the fourth auxiliary fold line 37, which is shaped into the upwardly curved line, in such a manner that the protruding tip end of the curved-line of the fourth auxiliary fold line 37 is held, on the lower side of the first auxiliary fold line 32, in contact with the protruding tip end of the curved-line or the vicinity of the protruding tip end of the first auxiliary fold line 32. At the same time, the body portion panel 5 is outwardly folded along the second auxiliary fold lines 33 and 34. In this manner, the body portion panel 5 on the upper side of the first auxiliary fold line 32 protrudes in a substantially flat boat-bottom shape. Then, due to the fact that the body portion panel 5 is outwardly folded along the second auxiliary fold lines 33 and 34, the substantially triangular surface 21*a* of the gable wall-forming panel 21 is also outwardly folded along the extensions of the second auxiliary fold lines 33 and 34 toward the seal-side vertex. In this manner, the substantially triangular surface 21*a* of the gable wall-forming panel 21 protrudes in the boat-bottom shape continuous with the body portion panel 5. As a result, the spout 47 is opened. The spout 47, which is opened as described above, exhibits a rhomboid shape slightly elongated in the longitudinal direction. Consequently, the spout 47 is largely opened.

In this case, if the first auxiliary fold line 32 is provided to the body portion panel 5 at the position which is lowered from the top-portion lateral-fold-line 19 by the length corresponding to the longitudinal width of the gable wall-forming panel 21, the spout 47 is largely opened at a maximum degree when the gable wall-forming panel 21, which is folded inside between the pair of gable roof-forming panels 13 and 14, is pulled out so as to be opened.

Further, even when the body portion of the container is strongly grasped upon pouring, a substantially flat surface of a boat-bottom shaped portion is hardly folded and the opening shape of the spout 47 is hardly changed or changed a little if changed. That is because the body portion panel 5 on the upper side of the first auxiliary fold line 32 and the substantially triangular surface 21*a* of the gable wall-forming panel 21 protrude in the substantially flat boat-bottom shape.

Further, in this embodiment, the second auxiliary fold lines 33 and 34 are shaped into the inwardly curved lines with respect to each other. As a result, when force is applied on the corner portions on the both sides of the boundary between the gable wall-forming panel 21 and the body portion panel 5 in such a manner that the corner portions are sandwiched from the both sides of the top-portion lateral-fold-line 19, the body portion panel 5 is guided by the second auxiliary fold lines 33 and 34 which are shaped into the inwardly curved lines with respect to each other. Then, the body portion panel 5 is outwardly folded along the second auxiliary fold lines 33 and 34. Thus, it is possible to easily cause the body portion panel 5 on the upper side of the first auxiliary fold line 32 to protrude in the substantially flat boat-bottom shape.

Further, in this embodiment, the substantially triangular surface 21*a* of the gable wall-forming panel 21 is provided with the third auxiliary fold lines 35 and 36 on the extensions of the second auxiliary fold lines 33 and 34. As a result, when force is applied on the corner portions on the both sides of the boundary between the gable wall-forming panel 21 and the body portion panel 5 in such a manner that the corner portions are sandwiched from the both sides of the top-portion lateral-fold-line 19, the body portion panel 5 is outwardly folded along the second auxiliary fold lines 33 and 34. Due to the above-mentioned folding, the substantially triangular surface 21*a* of the gable wall-forming panel 21 is also outwardly folded along the third auxiliary fold lines 35 and 36 on the extensions of the second auxiliary fold lines 33 and 34. Thus, it is possible to easily cause the substantially triangular surface 21*a* of the gable wall-forming panel 21 to protrude in the boat-bottom shape continuous with the body portion panel 5.

Figure 10:
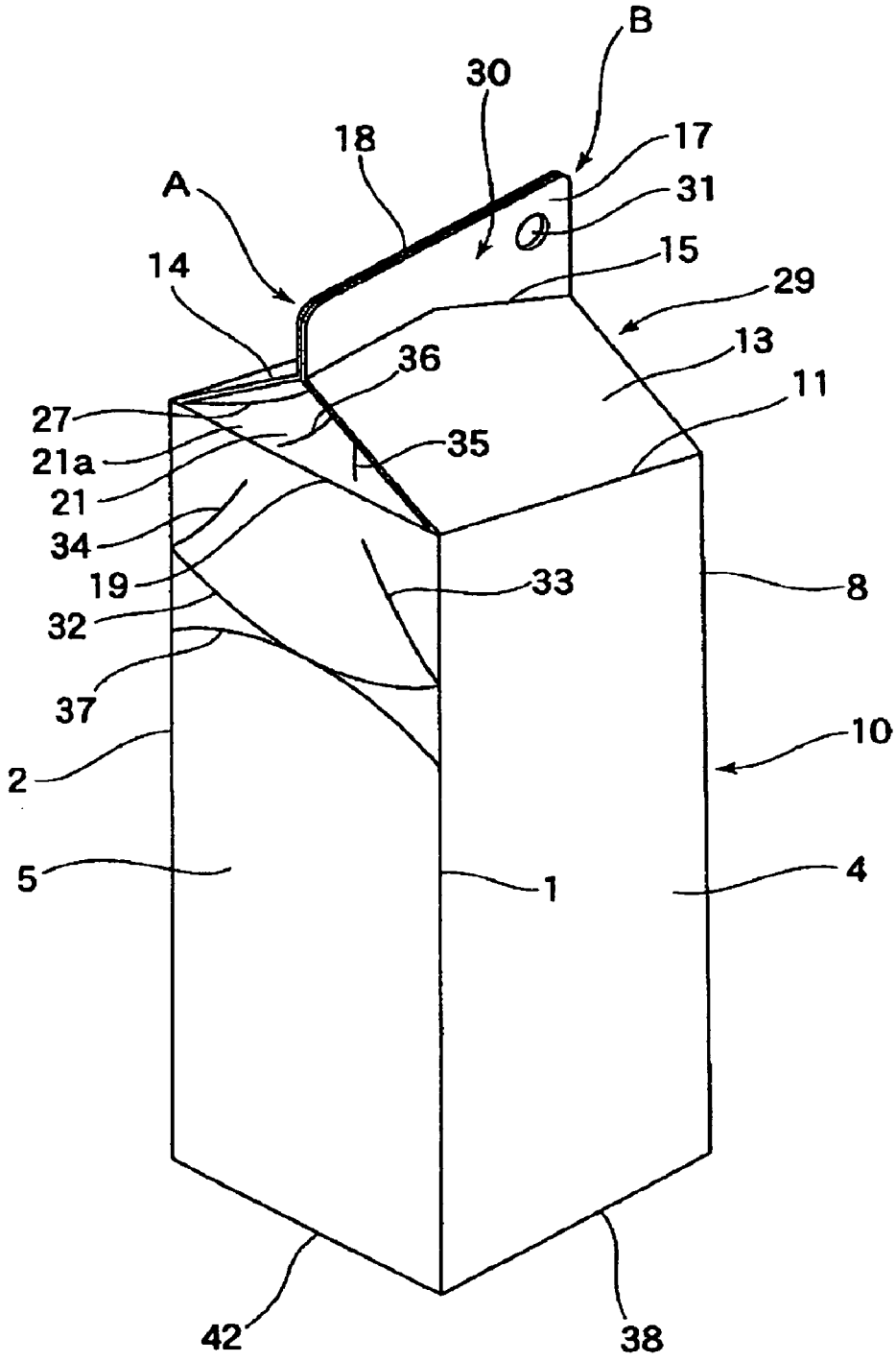
FIG. 10 A perspective view illustrating a paper container according to a second embodiment of the present invention.
Figure 11:
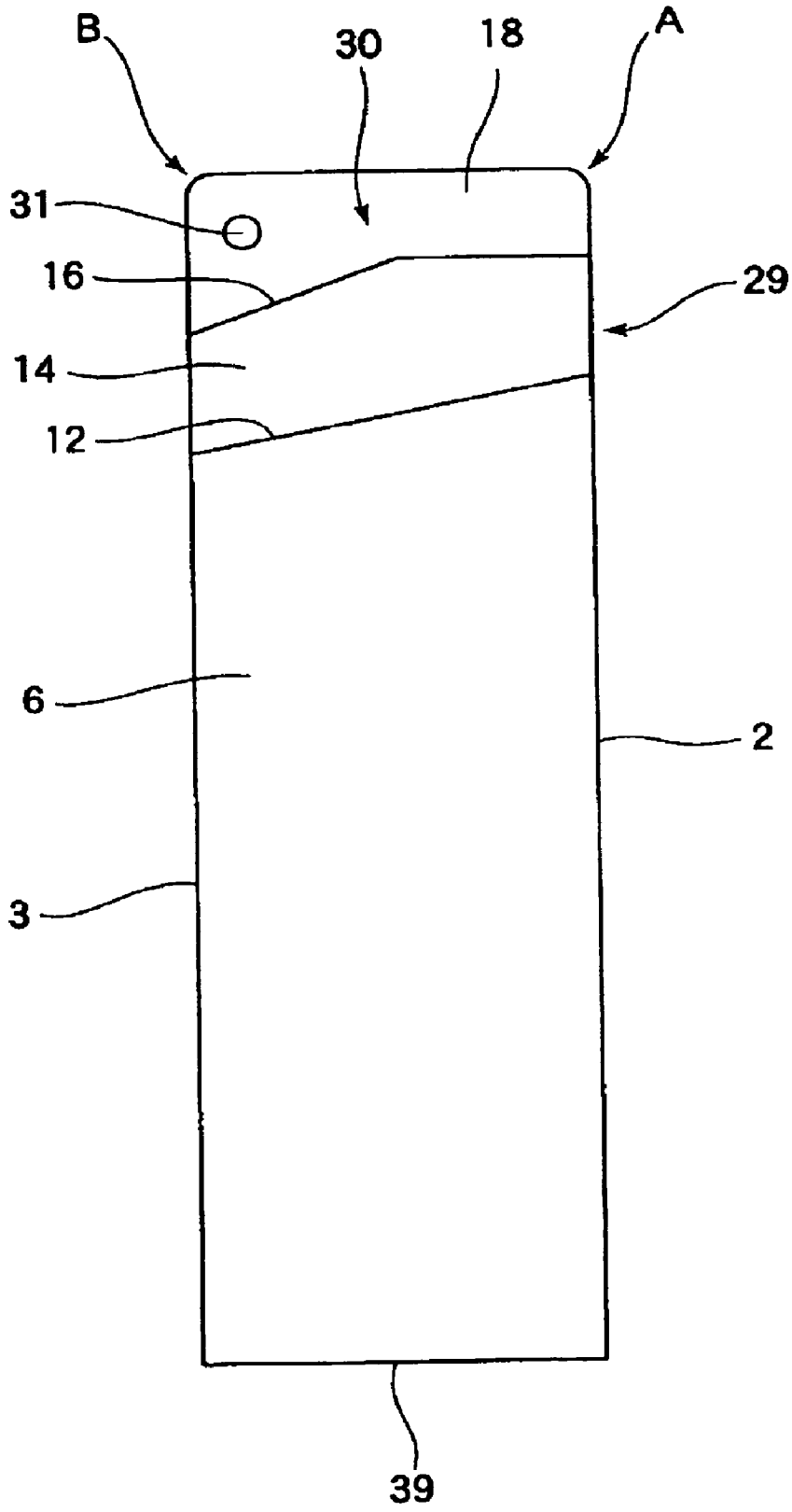
FIG. 11 A side view of the paper container illustrated in FIG. 10.
Figure 12:
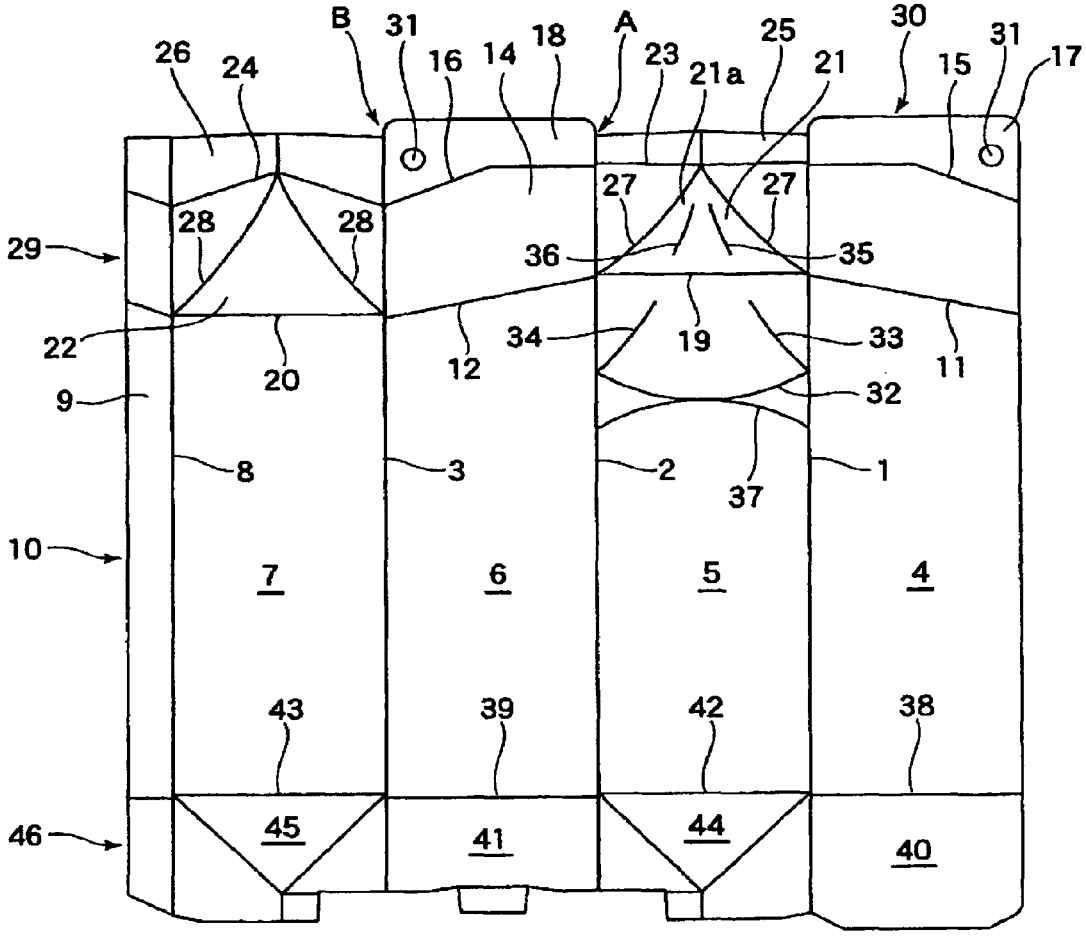
FIG. 12 A development view illustrating a carton blank before erection processing of the paper container illustrated in FIG. 10.

FIGS. 10 to 12 illustrate a paper container according to a second embodiment of the present invention. FIG. 10 is a perspective view illustrating the paper container according to this embodiment. FIG. 11 is a side view of the paper container illustrated in FIG. 10. FIG. 12 is a development view illustrating a carton blank before erection processing of the paper container illustrated in FIG. 10.

The paper container according to this embodiment is not different in its basic structure from that according to the first embodiment. The paper container according to this embodiment is described while structures identical to those according to the first embodiment are denoted by the reference numerals identical to those according to the first embodiment.

In this embodiment, the seal lateral fold lines 15 and 16 serving as boundaries between the exterior top seal panels 17 and 18, which determine the seal width of the top seal portion 30, and the pair of gable roof-forming panels 13 and 14 are shaped into straight lines. The straight lines extend horizontally from the opening side A to a substantially central position, and are downwardly tilted from the substantially central position toward the non-opening side B, respectively. The top seal portion 30 is formed by sealing the exterior top seal panels 17 and 18 and the interior top seal panels 25 and 26 with each other. Further, the top-portion lateral-fold-lines 11 and 12, which serves as boundaries between the pair of gable roof-forming panels 13 and 14 and the body portion panels 4 and 6, respectively, are shaped into straight lines. The straight lines are generally in parallel to a line linking an end portion on the opening side A and an end portion on the non-opening side B of the seal lateral fold lines 15 and 16, respectively.

Other structures are identical to those of the first embodiment, and hence the description of the first embodiment is incorporated herein and the description thereof is omitted.

According to the paper container of the second embodiment which is constituted as described above, the seal width of the top seal portion 30 is the same from the opening side A to the substantially central position, and hence a more stable seal state can be obtained.

Figure 13:
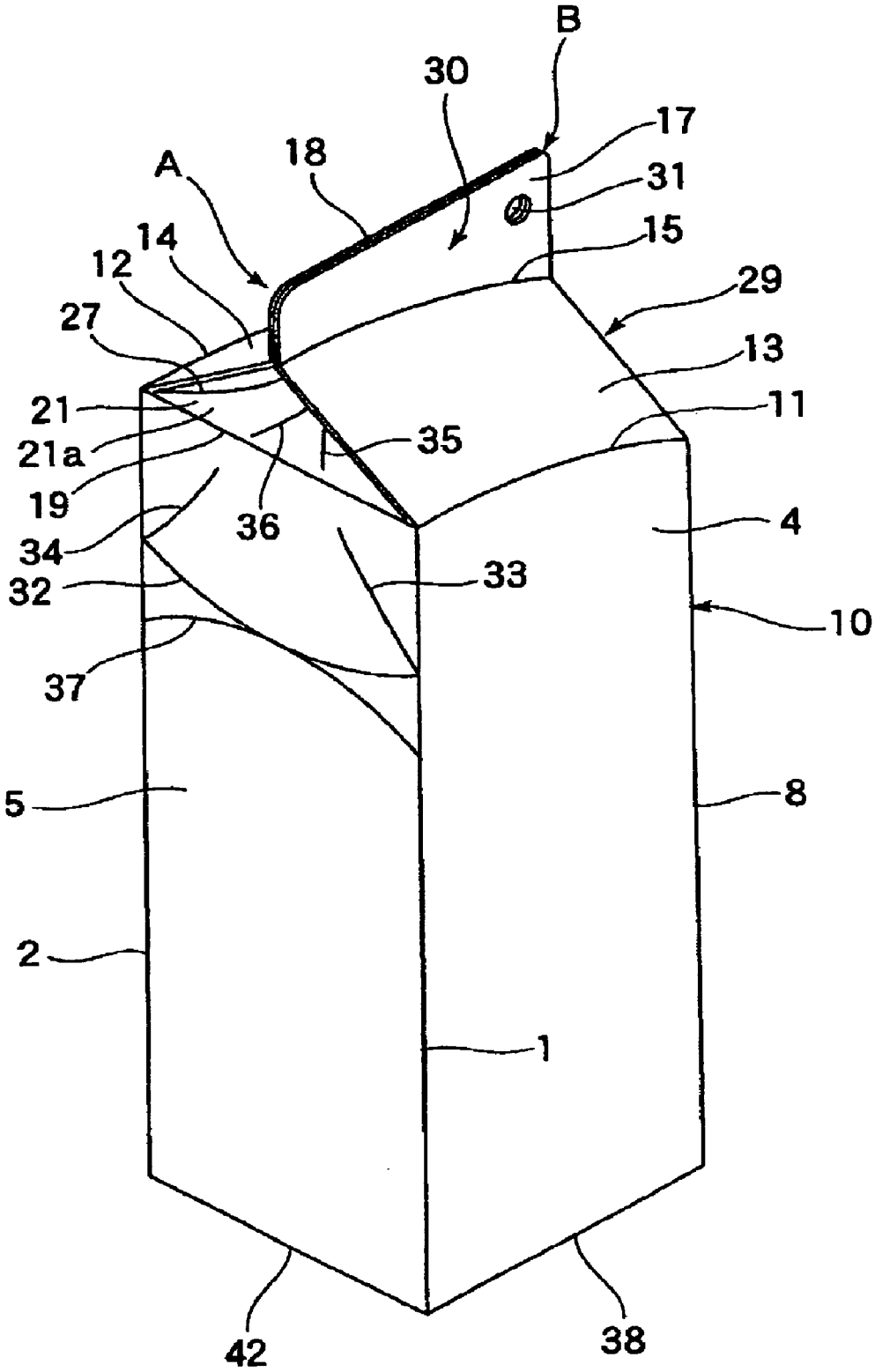
FIG. 13 A perspective view illustrating a paper container according to a third embodiment of the present invention.
Figure 14:
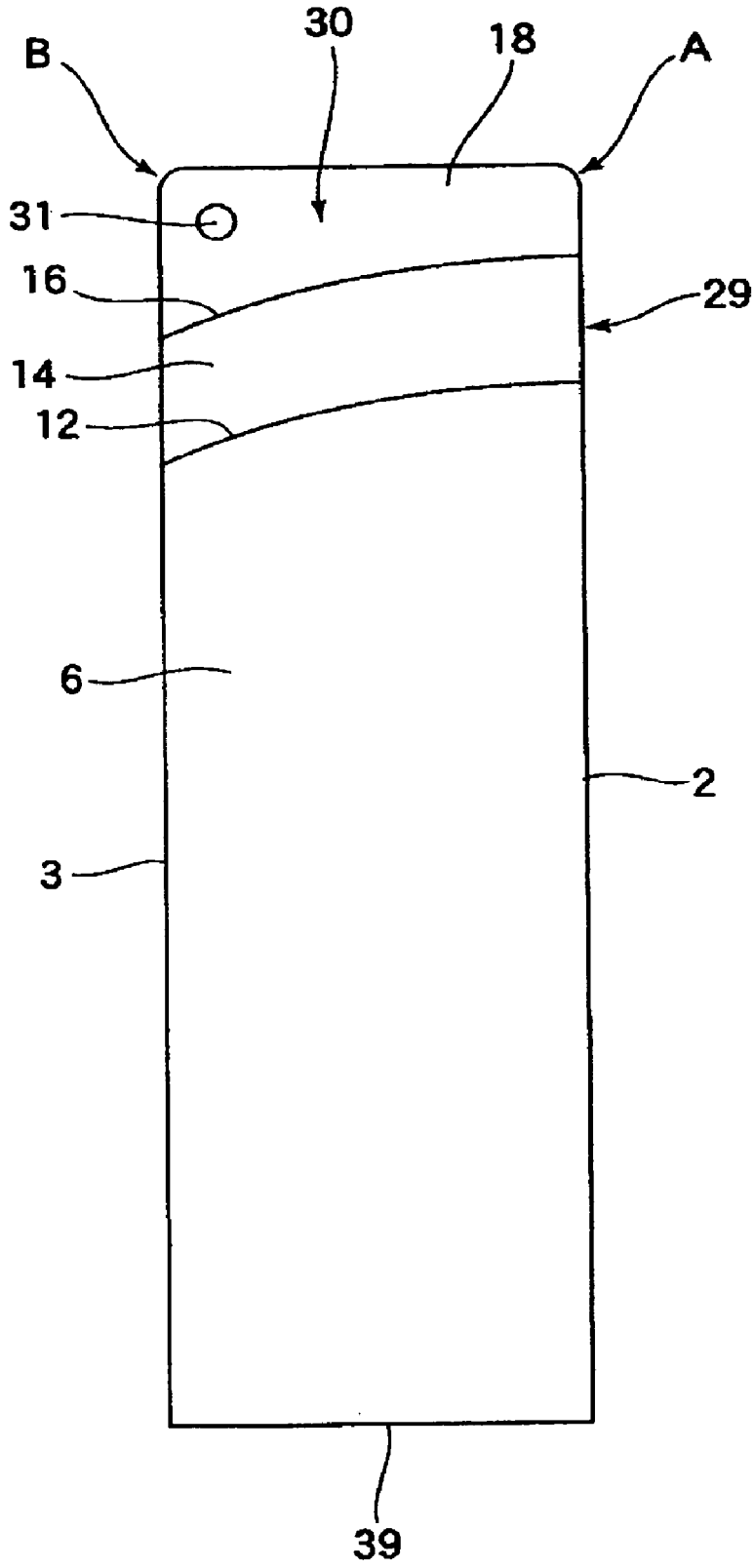
FIG. 14 A side view of the paper container illustrated in FIG. 13.
Figure 15:
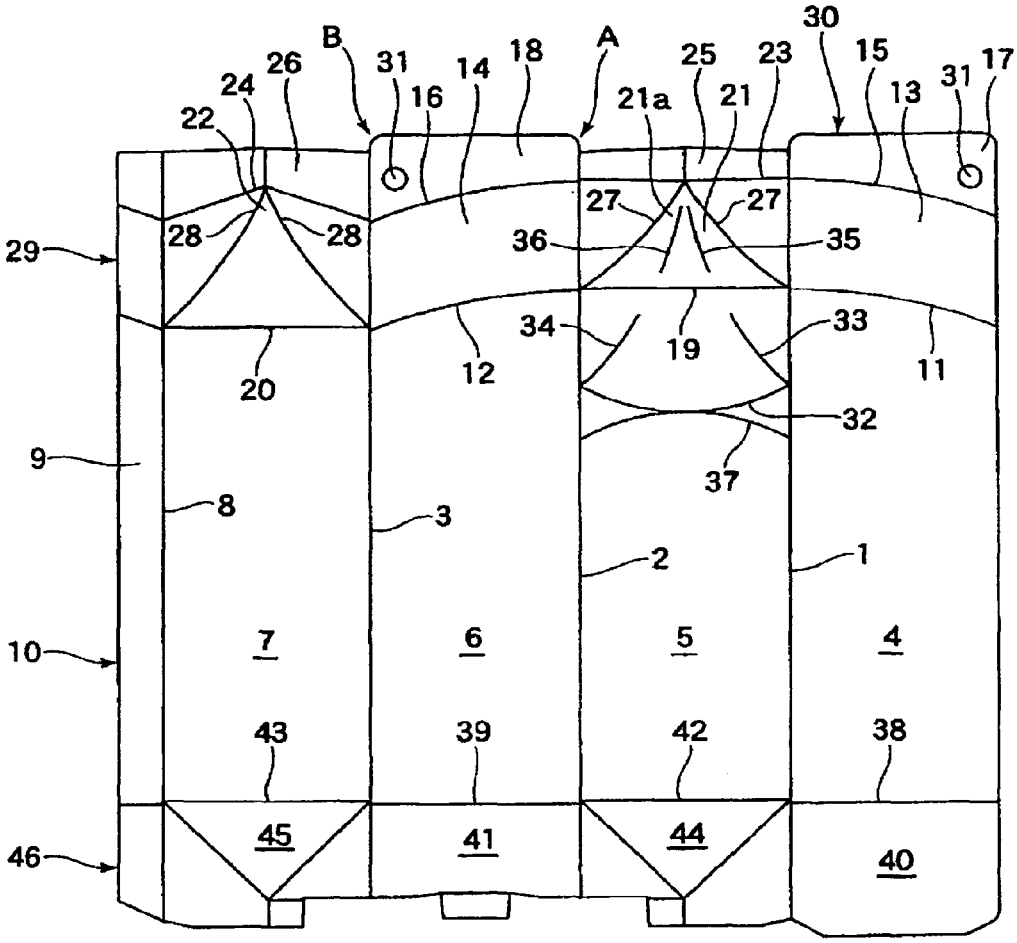
FIG. 15 A development view illustrating a carton blank before erection processing of the paper container illustrated in FIG. 13.

FIGS. 13 to 15 illustrate a third embodiment of a paper container according to the present invention. FIG. 13 is a perspective view illustrating the paper container according to this embodiment. FIG. 14 is a side view of the paper container illustrated in FIG. 13. FIG. 15 is a development view illustrating a carton blank before erection processing of the paper container illustrated in FIG. 13.

The paper container according to this embodiment is not different in its basic structure from that of the first embodiment. The paper container according to this embodiment is described while structures identical to those of the first embodiment are denoted by the reference numerals identical to those of the first embodiment.

In this embodiment, the seal lateral fold lines 15 and 16, which serve as boundaries between the exterior top seal panels 17 and 18, which determine the seal width of the top seal portion 30, and the pair of gable roof-forming panels 13 and 14, are shaped into upwardly curved lines (substantially circular arc) which are downwardly tilted from the opening side A toward the non-opening side B, respectively. The top seal portion 30 is formed by heating and sealing the exterior top seal panels 17 and 18 and the interior top seal panels 25 and 26 with each other at a predetermined position. Further, the top-portion lateral-fold-lines 11 and 12, which serve as boundaries between the pair of gable roof-forming panels 13 and 14 and the body portion panels 4 and 6, respectively, are shaped into the upwardly curved lines. The upwardly curved lines are tilted generally in parallel to the seal lateral fold lines 15 and 16, respectively.

Other structures are identical to those of the first embodiment, and hence the description of the first embodiment is incorporated herein and the description of the third embodiment is omitted.

According to the paper container of the third embodiment which is constituted as described above, the seal lateral fold lines 15 and 16, which serve as boundaries between the exterior top seal panels 17 and 18, which determine the seal width of the top seal portion 30, and the pair of gable roof-forming panels 13 and 14, are shaped into upwardly curved lines which are downwardly tilted from the opening side A toward the non-opening side B, respectively. Thus, a foldout stress of the gable wall-forming panels 21 and 22 is reduced by the seal lateral fold lines 15 and 16 which is shaped into the curved line, the foldout stress being applied to the gable wall-forming panels 21 and 22 when the pair of gable wall-forming panels 21 and 22 is folded inside between the pair of gable roof-forming panels 13 and 14. As a result, a more stable seal state can be obtained.

Further, the top-portion lateral-fold-lines 11 and 12 serving as boundaries between the pair of gable roof-forming panels 13 and 14 and the body portion panels 4 and 6 are shaped into the upwardly curved lines which is tilted generally in parallel to the seal lateral fold lines 15 and 16, respectively. Thus, when the tubular body portion 10 is grasped and held while the fingers touching the body portion panels 4 and 6 which are continuously provided to the pair of gable roof-forming panels 13 and 14 of the paper container which is opened by separating the opposed surfaces from each other, which are heated and sealed of the exterior top seal panels 17 and 18 and the interior top seal panels 25 and 26 on a side of the gable wall-forming panel 21 situating on the opening side A, the body portion panels 4 and 6 are deformed so as to be an inwardly curved surface by the top-portion lateral-fold-lines 11 and 12 which are formed into the upwardly curbed lines. As a result, the corner portions on the non-opening side B are posed in a state in which the corner portions correspondingly protrude. Therefore, the corner portions are hooked with the fingers grasping the body portion, and hence it is easy to hold. The other effects are the same as those of the first embodiment.

DESCRIPTION OF REFERENCE NUMERALS

1, 2, 3 body-portion longitudinal-fold-line
4,5,6,7 body portion panel
8 seal longitudinal fold line
9 longitudinal-direction seal-panel
10 cylindrical body portion
11, 12 top-portion lateral-fold-line
13, 14 gable roof-forming panel
15, 16 seal lateral fold line
17, 18 exterior top seal panel
19, 20 top-portion lateral-fold-line
21, 22 gable wall-forming panel
23, 24 seal lateral fold line
25, 26 interior top seal panel
27, 28 foldout line
29 top
30 top seal portion
31 hole
32 first auxiliary fold line
33, 34 second auxiliary fold line
35, 36 third auxiliary fold line
37 fourth auxiliary fold line
38, 39 bottom-portion lateral-fold-line
40, 41 exterior panel
42, 43 bottom-portion lateral-fold-line
44, 45 interior panel
46 bottom portion
47 spout

The invention claimed is:

1. A paper container having a gable roof and being formed of a board paper raw material having a top surface and a back surface laminated with thermoplastic resins, said paper container comprising:

four body portion panels configured such that edge portions of the paper container are bonded with each other through a longitudinal-direction seal-panel so as to form a tubular body portion having a square section, wherein upper ends of the body portion panels are continuously provided with:

a pair of gable roof-forming panels, including exterior top seal panels at upper portions of the pair of gable roof-forming panels, the exterior top seal panels being opposed to each other, and a pair of gable wall-forming panels, including interior top seal panels at upper portions of the pair of gable wall-forming panels, the interior top seal panels being opposed to each other, a first one of the pair of gable wall-forming panels serves as a spout and is to be opened, wherein the pair of gable wall-forming panels is folded inside between the pair of gable roof-forming panels, wherein the exterior top seal panels and the interior top seal panels are heated and sealed with each other at a predetermined position so as to be hermetically sealed, to thereby form a top of the paper container, wherein a seal width on a non-opening side of a top seal portion is larger than a seal width on an opening side serving as the spout, the top seal portion being formed by heating and sealing the exterior top seal panels and the interior top seal panels with each other at the predetermined position, the seal width being downwardly enlarged from the opening side to the non-opening side; and wherein top-portion lateral-fold-lines serving as boundaries between the pair of gable roof-forming panels and an opposing pair of the body portion panels are downwardly tilted from the opening side to the non-opening side.

2. A paper container according to claim 1, wherein:

seal lateral fold lines serving as boundaries between the exterior top seal panels determining the seal width of the top seal portion, and the pair of gable roof-forming panels are shaped into straight lines which are downwardly tilted from the opening side to the non-opening side; and the top-portion lateral-fold-lines serving as the boundaries between the pair of gable roof-forming panels and the body portion panels are shaped into straight lines tilted generally in parallel to the seal lateral fold lines.

3. A paper container according to claim 1, wherein:

seal lateral fold lines serving as boundaries between the exterior top seal panels determining the seal width of the top seal portion, and the pair of gable roof-forming panels are shaped into straight lines horizontally extending from the opening side to a substantially central position, and which are downwardly tilted from the substantially central position to the non-opening side; and the top-portion lateral-fold-lines serving as the boundaries between the pair of gable roof-forming panels and the body portion panels are shaped into straight lines each generally in parallel to a line linking an end portion on the opening side and an end portion on the non-opening side of each of the seal lateral fold lines.

4. A paper container according to claim 1, wherein:

seal lateral fold lines serving as boundaries between the exterior top seal panels determining the seal width of the top seal portion, and the pair of gable roof-forming panels are shaped into upwardly curved lines downwardly tilted from the opening side to the non-opening side; and the top-portion lateral-fold-lines serving as the boundaries between the pair of gable roof-forming panels and the body portion panels are shaped into upwardly curved lines which are tilted generally in parallel to the seal lateral fold lines.

5. A paper container according to claim 1, wherein:

a first one of the body portion panels is continuously provided via a first one of the top-portion lateral-fold-lines to the first one of the gable wall-forming panels on the opening side, the first one of the body portion panels being provided with a first auxiliary fold line shaped into a downwardly curved line, the first auxiliary fold line traverses the first one of the body portion panels and merges into body-portion longitudinal-fold-lines on both sides of the first one of the body portion panels or a vicinity thereof, and the first one of the body portion panels is provided with first auxiliary fold line, the body-portion longitudinal fold lines extending from respective ends of the first auxiliary fold line or a vicinity thereof toward a seal-side vertex of a substantially triangular surface of the first one of the gable wall-forming panels on the opening side and merging into the first one of the top-portion lateral-fold-lines or a vicinity thereof, the seal-side vertex being formed by being folded inside between the pair of gable roof-forming panels.

6. A paper container according to claim 5, wherein a pair of second auxiliary fold lines are shaped into inwardly curved lines with respect to each other.

7. A paper container according to claim 5, wherein the substantially triangular surface of the first one of the gable wall-forming panels on the opening side is provided with a pair of third auxiliary fold lines on extensions of the pair of second auxiliary fold lines.

8. A paper container according to claim 5, wherein the first one of the body portion panels is continuously provided to the first one of the gable roof-forming panels, the first one of the body portion panels being provided with a fourth auxiliary fold line in such a manner that a protruding tip end of a curved-line of the fourth auxiliary fold line is held, on a lower side of the first auxiliary fold line, in contact with a protruding tip end of a curved-line of the first auxiliary fold line or a vicinity thereof, the fourth auxiliary fold line being shaped into an upwardly curved line which traverses the first one of the body portion panels and merges into the body-portion longitudinal fold lines on both sides of the first one of the body portion panels or the vicinity thereof.

* * * * *